US005423172A

United States Patent [19]

Furtmeier et al.

[11] Patent Number: 5,423,172

[45] Date of Patent: Jun. 13, 1995

[54] OPEN-END SPINNING DEVICE

[75] Inventors: Anton Furtmeier, Neustadt; Josef Breitenhuber, Buxheim, both of Germany

[73] Assignee: Rieter Ingolstadt Spinnereimaschinenbau AG, Ingolstadt, Germany

[21] Appl. No.: 103,630

[22] Filed: Aug. 6, 1993

[30] Foreign Application Priority Data

Aug. 14, 1992 [DE] Germany ..... 42 27 016.2

[51] Int. Cl.[6] ..... D01H 4/08; D01H 4/38

[52] U.S. Cl. ..... 57/407; 57/413

[58] Field of Search ..... 57/406, 407, 408, 411, 57/413

[56] References Cited

U.S. PATENT DOCUMENTS 3,861,132 1/1975 Stahlecker et al. ..... 57/407
3,874,154 4/1975 Stahlecker et al. .
3,927,516 12/1975 Stahlecker ..... 57/407
4,051,654 10/1977 Bartling .
4,122,655 10/1978 Anderson et al. ..... 57/407
4,516,396 5/1985 Stahlecker et al. .
4,653,266 3/1987 Oexler et al. ..... 57/407
5,111,651 5/1992 Pohn et al. ..... 57/411 X

FOREIGN PATENT DOCUMENTS 2542694 11/1976 Germany .

*Primary Examiner*—Joseph J. Hail, III
*Attorney, Agent, or Firm*—Dority & Manning

[57] ABSTRACT

The opener roller housing of an open and spinning device is provided with a stop for a rotor cover and for axial adjustment of the rotor shaft support. The stop is located on the side of the fiber feeding channel section of the opener roller housing which is closest to the open-end spinning rotor and is preferably an integral part of the opener roller housing. The stop is furthermore connected to a guide for the rotor cover.

15 Claims, 2 Drawing Sheets

OPEN-END SPINNING DEVICE

BACKGROUND OF THE INVENTION

The instant invention relates to an open-end spinning device with an open-end spinning rotor having an open side, a rotor bearing equipped with support disks and an axially adjustable rotor shaft support, an opener roller housing, a swivelling rotor cover, a fiber feeding channel with a first fiber feeding channel section located in the opener roller housing, and an additional fiber feeding channel section contained in the swivelling rotor cover which can be swivelled from a rest position, in which the open rotor side is uncovered, into a work position in which the two fiber feeding channel sections are aligned with each other.

It is a known technique to make rotor housings of pressure-cast aluminum and to adjust the rotor bearing with the supporting disks in relation to the rotor housing so that the open-end spinning rotor located in the rotor housing assumes an axial position defined by the rotor bearing. The rotor bearing is furthermore designed as a stop for a rotor cover which contains a section of the fiber feeding channel (DE-OS 2.161.619).

Because of cost considerations, the rotor housing is more often made of plastic and held in its work position by being snapped in its work position (DE 32 47 411 A1). However, such a rotor housing leads to imprecise adjusting conditions.

OBJECTS AND SUMMARY OF THE INVENTION

It is a principal object of the instant invention to provide an open-end spinning device wherein the interacting elements of the open-end spinning device can be adjusted precisely in relation to each other. Additional objects and advantages of the invention will be set forth in part in, or will be obvious from, the following description:

The objects are attained by the invention in that the opener roller housing is provided with a stop designed so that either interaction with the rotor cover or reception of a gauge for axial adjustment of the rotor shaft support can be selected. The rotor housing is not taken into consideration for the adjustment of the rotor cover in relation to the spinning rotor which is in turn adjusted by means of the gauge in relation to the opener roller housing and thereby also in relation to the rotor cover. In this manner, imprecision in the positioning of said rotor housing and its possible flexibility for the interacting elements is of no significance.

Since the transition from one fiber feeding channel section into the other is of great significance, provisions are made in a preferred embodiment of the invention for the stop to be located near the fiber feeding channel section of the opener roller housing and thereby advantageously on the side of the fiber feeding channel section of the opener roller housing nearest to the open-end spinning rotor.

For reasons of manufacturing and cost it is especially advantageous for the stop to be an integral part of the opener roller housing.

So that no special adjusting element (gauge) need be provided for the precise positioning of the opener roller housing, it is possible to make the stop so as to be effective on two sides and to design it as a stop for interaction with a support supporting the opener roller housing on the side away from the stop side interacting with the rotor cover.

In an especially advantageous embodiment of the invention, the stop is connected to a guide of the rotor cover, so that the latter is certain to bear upon the stop in the desired position. It is advantageous in this case for the guide to be an integral part of the stop in order to avoid having to adjust the guide. The guide is preferably connected on both sides to the stop of the rotor cover and thus forms a U with the stop, it being advantageous here for the guide to be provided with centering ramps for the rotor cover.

In principle the adjustment of the rotor shaft support can be effected in different manners. Thus it is possible to design the stop for selective interaction with the rotor cover or with a gauge. To avoid a slanted positioning of the rotor cover in its operating position or of the gauge(s), another advantageous embodiment of the device according to the invention provides for the rotor cover and/or the gauge to be equipped with a connecting element having an adapted profile which interacts with the stop and/or with the (single-section or double-section) guide.

In another advantageous embodiment of the device according to the invention, it is possible to insert a gauge which can be exchanged against a yarn draw-off nozzle into the rotor cover, it being possible to bring the gauge to bear against a shaft-like gauge in the nip of the supporting disks.

The main interacting parts of the spinning device, such as spinning rotor, rotor cover and the fiber feeding channel sections, can be adjusted easily and precisely in relation to each other by means of the device designed according to the invention. It is here also possible to implement the invention by retrofitting it on existing spinning stations by retrofitting the stop on the opener roller housing or by exchanging it against one which is designed in accordance with the invention.

The invention is explained in greater detail below with the help of embodiments as depicted in the figures, which constitute a part of this description.

DETAILED DESCRIPTION OF THE PREFERRED EMBODIMENTS

Figure 1:
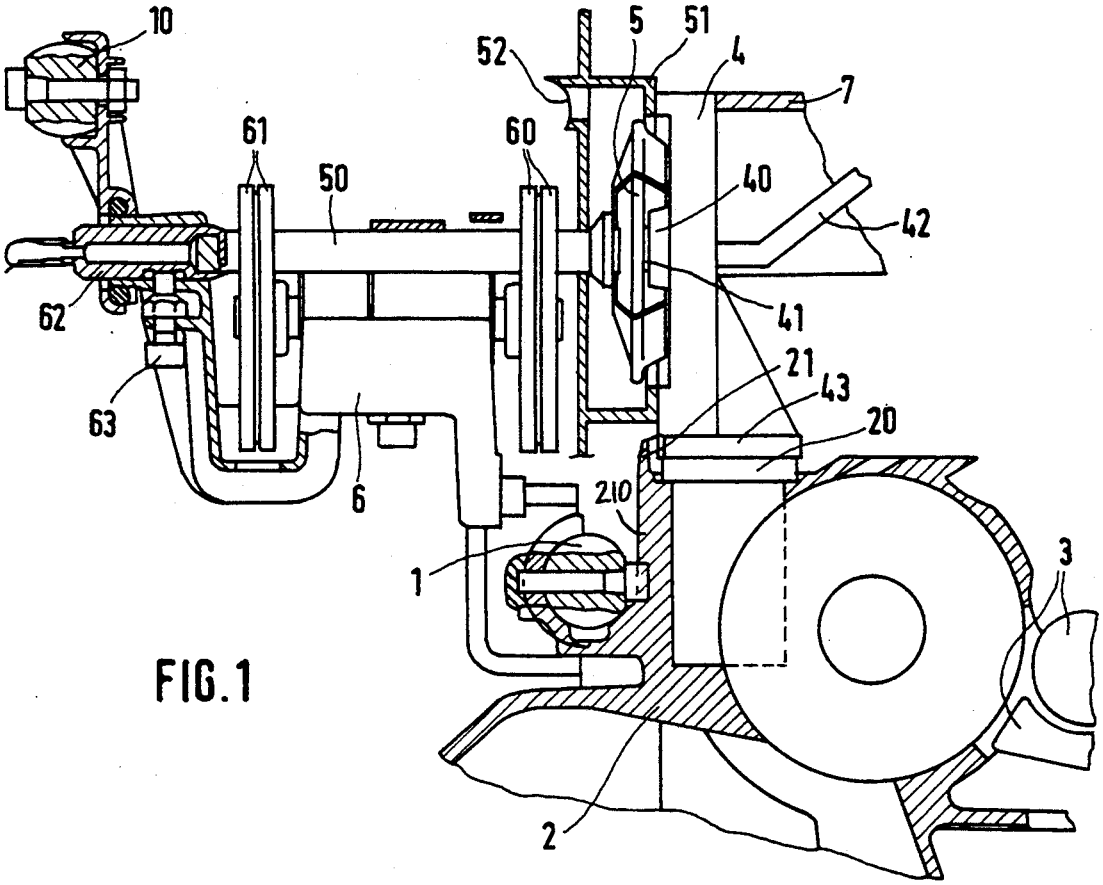
FIG. 1 shows an open-end spinning device designed according to the invention in spinning position in a side view, in partial section.

Reference will now be made in detail to the presently preferred embodiments of the invention, one or more of which are illustrated in the drawings. Each example is provided by way of explanation of the invention, not limitation of the invention. The numbering of components in the drawings is consistent throughout the application, with the same components having the same number in each of the drawings.

In FIG. 1 the essential parts of an open-end spinning device which are needed to understand the invention are shown.

An opener roller housing 2 is mounted on a rod 1 extending in the longitudinal sense of the open-end spinning machine and is held in the shown rotary position by another rod (not shown). An opener roller (not shown) which opens a fiber sliver (also not shown) fed through the feed device 3 is installed in the opener roller housing 2.

An insert 20 which receives the first section of a fiber feeding channel (not shown) is mounted in the opener roller housing 2. A second section of this fiber feeding channel (also not shown) is located in a rotor cover 4 which extends with an extension 40 into the spinning rotor 5. The spinning rotor 5 is mounted on a shaft 50 which is supported by two pairs of supporting disks 60 and 61. The supporting disk pairs 60 and 61 are supported by a bearing housing 6 which receives an axially shiftable rotor shaft support 62. The rotor shaft support 62 is fixed in its position by a clamping screw 63 in such a position that the spinning rotor 5 which presses with its shaft 50 against the front of the rotor shaft support 62 is at the desired distance from the rotor cover 4.

On its side towards the spinning rotor 5, the rotor cover 4 is provided with a replaceable draw-off nozzle 41 in its extension 40 through which a yarn (not shown) which is spun in the spinning rotor 5 can be drawn off. On the side away from spinning rotor 5, a yarn draw-off pipe 42 is installed in the rotor cover 4, and through it the yarn withdrawn from the spinning rotor 5 goes to a pair of draw-off rollers (not shown) which withdraw the yarn from the spinning rotor 5 and feed it to a winding device (not shown). The rotor cover 4 is supported by a cover 7 of the open-end spinning device and can be moved together with it into the operating position shown in FIG. 1, as well as into a rest position which is not shown and into an intermediary position in which the spinning rotor 5 is braked.

The bearing housing 6, with the supporting disk pairs 60 and 61 and with the rotor shaft support 62, is supported on one side of rod 1 in the same manner as the opener roller housing 2. A rod 10 serves as an opposite support, so that the bearing housing 6 is held securely by rods 1 and 10.

The spinning rotor 5 (FIG. 1 also shows a smaller rotor in a section to indicate that different rotor sizes can be used in the spinning device) is located in a rotor housing 51 which is connected via a suction connection 52 to a negative-pressure source which is not shown.

The rotor housing 51 is held in its operating position in a manner not shown on the rod 1 on the one hand and on a rod (not shown) located above the rotor housing 51 on the other hand. Because of the desired rapid-replacement capability this rotor housing 51 is not screwed to the two rods but is held in its operating position merely by snapping in. The rotor housing 51 is made of plastic.

As mentioned earlier, the position of the spinning rotor 5 in relation to the rotor cover 4 is determined by the position of the rotor shaft support 62. The position of the rotor housing 51 is unimportant for this position of the spinning rotor 5.

The rotor cover 4 is given its precise relative position in relation to the spinning rotor 5 by a stop 21 which is an integral part of the opener roller housing 2. This stop is located directly below the rotor housing 51, on the side of opener roller housing 2 towards the bearing housing 6, near the fiber feeding channel section (not shown) located in said opener roller housing 2 which is here located on the side of insert 20 towards the bearing housing 6, i.e. towards the spinning rotor 5, and thereby near the fiber feeding channel section located in said insert 20. As a result, the stop 21 is in closest possible proximity of the spinning rotor 5, so that the position of the rotor cover 4 in relation to the spinning rotor 5 can be determined with great precision.

Figure 2:
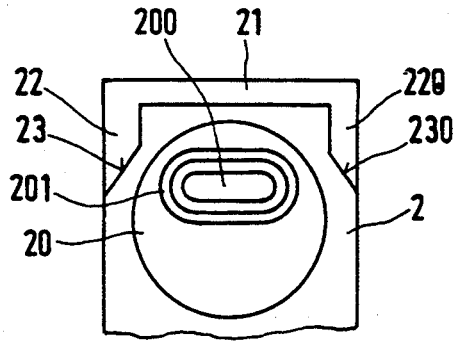
FIG. 2 shows a top view on the outlet opening of the fiber feeding channel section located in the opener roller housing.

FIG. 2 shows a portion of the opener roller housing 2 with insert 20 in which the outlet opening of the first section 200 of the fiber feeding channel can be identified. This outlet is surrounded by a groove 201 which is adapted to the configuration of the outlet opening and in which an O-ring is inserted for sealing interaction with the rotor cover 4. The stop 21 extends over the full width of the opener roller housing 2 and merges at its two ends into two guides 22 and 220 which merge at their ends away from stop 21 into two centering ramps 23 and 230.

When the rotor cover 4 is brought from its open position into the operating position shown in FIG. 1, the rotor cover 4 runs up with its connection element 43 on the one side against the insert 20 which is elastically supported in the axial direction in the opener roller housing 2 and is brought into the correct position in relation to the outlet opening of part 200 of the fiber feeding channel by the centering ramps 23 and 230. The rotor cover 4 is now centered between the two guides 22 and 220 and finally comes to bear against stop 21, a position in which the second section of the fiber feeding channel located in the rotor cover 4 is in every respect precisely aligned with its first section 200. In addition, in this bearing position, the rotor cover 4 has also reached its precise position in relation to the spinning rotor 5 whose axial position has been determined by the rotor shaft support 62. The rotor cover 4 is fixed in the operating position by a locking mechanism (not shown) between cover 7 and the opener roller housing 2, so that the attained relative position between rotor cover 4 and spinning rotor 5 is maintained during the entire operation.

The precise adjustment of the rotor shaft support 62 in relation to the opener roller housing 2 is thus of crucial significance for the attainment of a precise relative position between spinning rotor 5 and rotor cover 4. For this reason, provisions are made according to FIGS. 3 and 4 for the adjustment of the rotor shaft support 62 to be effected as a function of the position of the stop 21 of the opener roller housing 2 which is thus not only able to interact with the rotor cover 4 (in operating position), but is also used for the axial adjustment of the rotor shaft support 62. This adjustment can be made in different manners.

Figure 3:
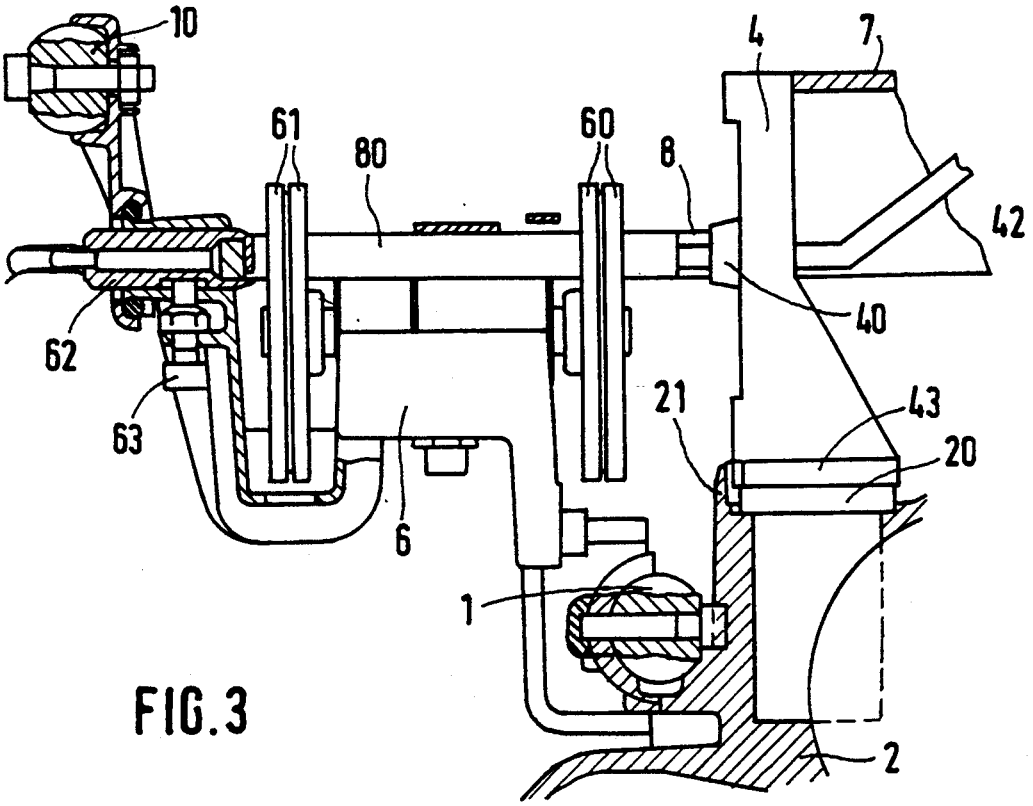
FIG. 3 shows the device shown in FIG. 1, with inserted two-part gauge, in a side view.

According to FIG. 3 a gauge 8 is screwed into the insert 40 of the rotor cover 4 once the draw-off nozzle 41 has been removed from the insert 40 of the rotor cover. In the adjusting position of gauge 8, the distance between its front away from the rotor cover 4 and the side of the rotor cover 4 towards the gauge 8 is precisely defined.

Before the rotor cover 4 is brought into its position shown in FIG. 3, the spinning rotor 5 together with its shaft 50 has been removed from the nip of the two supporting disk pairs 60 and 61, whereupon a shaft-like gauge 80 has been introduced into the nip and has been brought to bear upon the rotor shaft support 62. The gauge 80 is of a length that is different from the length of shaft 50 of the spinning rotor 5 in such a manner that a spinning rotor 5 inserted into the supporting disk pairs 60 and 61 after the adjustment of the rotor shaft support 62 precisely maintains the required, and therefore desired, distance from the rotor cover 4.

The clamping screw 63 is loosened to adjust the rotor shaft support 62 and when the gauge 80 has been introduced into the nip of the pair of supporting disks 60 and 61 and the rotor cover 4, together with its gauge 8, has been brought to bear upon the gauge 80 said rotor shaft support 62, is shifted in such manner that the rotor shaft support 62 is pressed with its forward side against the gauge 80 without the rotor cover 4 being removed from the stop 21. When the rotor shaft support 2 has reached its precise position, the clamping screw 63 is tightened again.

When the rotor shaft support 62 has been adjusted the rotor cover 4 is opened again and the gauge 8, which may have a multi-edge profile for example, is unscrewed from the extension 40 of the rotor cover 4 so that the customary draw-off nozzle 41 (see FIG. 1) can be screwed back in. Gauge 80, which had been introduced into the nip of the supporting disk pair 60 and of the supporting disk pair 61 in the manner of a rotor shaft is now pulled out. The rotor housing 51 is now inserted and fixed on its two rods by snapping it in. The desired spinning rotor 5 can now be introduced through the opening in the bottom of the rotor housing 51 into the nip of the two supporting disk pairs 60 and 61 to be pressed against the rotor shaft support 62. The spinning station is now prepared for a spinning process.

As shown in FIG. 3, the adjustment of the rotor shaft support can be effected without the rotor housing 51 being in its place. On the other hand it does not matter at all whether this rotor housing 51 is in a built-in or removed state. The adjustment with an inserted rotor housing 51 is just as well possible as with a removed rotor housing 51.

Figure 4:
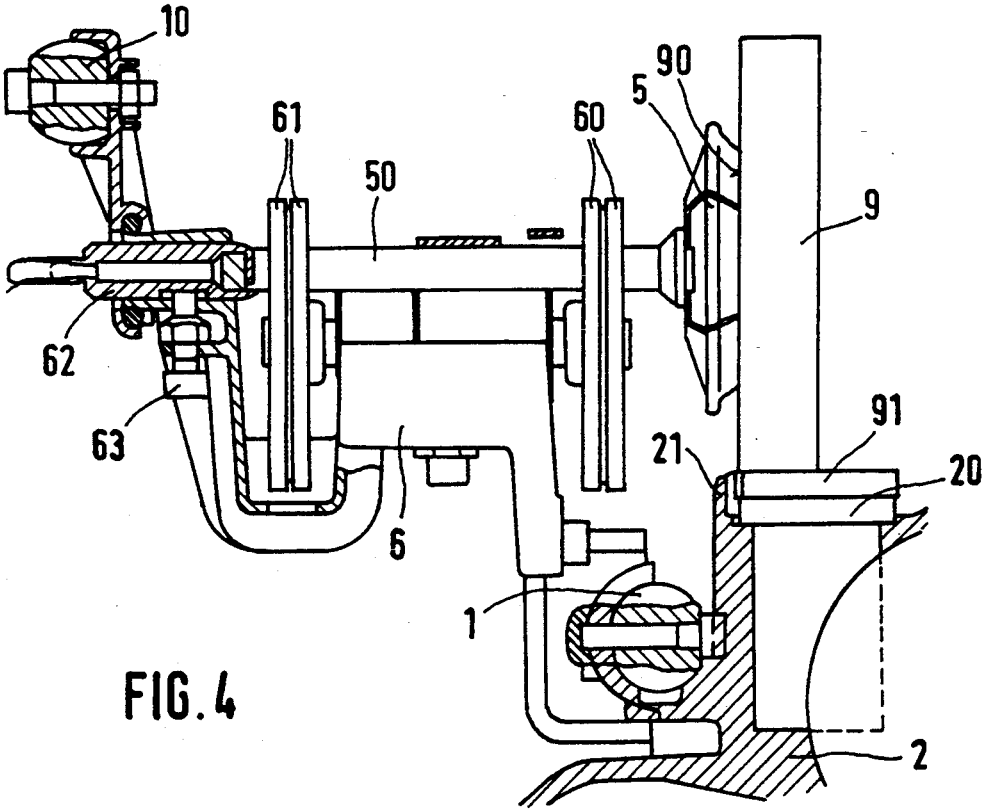
FIG. 4 shows the device shown in FIG. 1 in a side view, with another single-element gauge according to the invention.

FIG. 4 shows another possibility for the adjustment of the rotor shaft support 62. In this case the spinning rotor 5 is used with its shaft 50 as the adjustment gauge. Although the rotor housing 51 is not shown here, the adjustment of the rotor shaft support 62 can be effected here too independently of whether the rotor housing 51 is built in or removed during the adjustment. In the embodiment shown in FIG. 4, a gauge 9 is brought to bear against the stop 21 of the opener roller housing 2. The gauge 9 is provided with a surface 90 which is coordinated with the exact positioning of the spinning rotor 5 and against which the spinning rotor 5 is to bear with its forward side in a flush manner. Then, after loosening the clamping screw 63, the rotor shaft support 62 is brought into its correct position in which it bears against the free end of shaft 50 of the spinning rotor 5 and in which the spinning rotor 5 also bears flush against the surface 90 of the gauge 9 while the latter bears upon stop 21. Stop 21 is thus designed for selective interaction with the rotor cover 4 (during production) or with the gauge 9 (during adjustment).

The open-end spinning device, and here in particular the opener roller housing 2, can be varied in many ways within the framework of the instant invention, e.g. by replacing characteristics by equivalents or by using them in some other combination. Thus, it is not absolutely required, although especially advantageous, for the stop 21 (as described above) to be an integral part of the opener roller housing 2. It is also possible to provide a suitable mounting surface for the stop 21 on the opener roller housing 2 and to connect the stop 21 by screwing it to the opener roller housing 2.

Neither is it absolutely necessary for stop 21 to be located on the side of insert 20 (which can also be replaced by an equivalent integral part of the opener roller housing 2) towards the spinning rotor 5. Any other location with which the rotor cover 4 can interact can also be considered.

It is furthermore possible to provide a round outer contour for the connection element 43 of the rotor cover 4, while the stop 21 and, if this is provided for, also the guide 22, 220, is provided with a flat contact (or guiding) surface interacting with the connection element 43. Preferably however, the connection element 43 is provided with a contact surface (not shown) that is parallel with the contact surface of stop 21, so that the danger of an oblique contact of the rotor cover 4 with the stop 21 is eliminated. It is best if the entire outer edge of the connection element 43 of the rotor cover 4 is designed to be complementary to the configuration of the unit made into the stop 21 and the guide 22,220, but it is also sufficient, for an optimal result, if at least either the surfaces interacting with the stop surface or those interacting with the guide 22, 20 are parallel thereto. What has been said about the rotor cover 4 and its connection element 43 also applies by analogy to the gauge 9 and its stop element 91.

The extended side 210 of stop 21, across from the side interacting with the gauge 9 or the rotor cover 4, can be designed as a stop of the opener roller housing 2 opposite of rod 1 if desired, as is shown in the figures.

Guide 22, 220, instead of being an integral part of stop 21, can also be screwed to the stop or attached to it in some other manner, if desired. The guide can also be made in one piece as a ridge upon which the rotor cover 4 runs up in its closing movement, whereby centering ramps on the right and left side of the ridge-like guide or in the rotor cover 4 are also advantageous. Similarly, gauge 9 can also be provided with a corresponding, complementary guide. Also, the guide on the opener roller housing 2 need not absolutely be located directly at the stop 21 but depending on design, can also be placed at a distance from stop 21, whereby the mentioned centering ramps could possibly also be dispensed with.

It will be apparent to those skilled in the art that various modifications and variations can be made in the invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents.

We claim:

1. An open-end spinning device comprising an open-end spinning rotor housed in a rotor housing and configured at one end of a rotor shaft; a rotor bearing provided with supporting disks and an axially shiftable rotor shaft support; an opener roller housing; a swivelling rotor cover which can be swivelled relative said opener roller housing from an operating position to a rest position in which said open end of said spinning rotor is uncovered; a fiber feeding channel comprising a first fiber feeding channel section installed in said opener roller housing and a second fiber feeding channel section contained in said swivelling rotor cover, in said operating position of said rotor cover said first and second fiber feeding channel sections being aligned with each other, said open-end spinning device further comprising a stop defined on said opener roller housing, said stop being stationary relative said opener roller housing said stop defining a first stop surface engaged by said rotor cover in said operating position for positioning said rotor cover with respect to said opener roller housing, said stop also configured so that precise axial adjustment of said rotor shaft support can be obtained as a function of the position of said stop on said opener roller housing, said open-end spinning rotor thereby being precisely positioned at a desired position within said rotor housing by way of said stop, said opener roller housing, and said rotor shaft support.

2. The open-end spinning device as in claim 1, wherein said stop is disposed generally adjacent said first fiber feeding channel section of said opener roller housing.

3. The open-end spinning device as in claim 2, wherein said stop is disposed on the side of said first fiber feeding channel section nearest to said spinning rotor.

4. The open-end spinning device as in claim 1, wherein said stop is formed integral with said opener roller housing.

5. The open-end spinning device as in claim 1, further comprising a support for said opener roller housing, said stop further comprises a second stop surface for interacting with said support generally at a side opposite said first stop surface.

6. The open-end spinning device as in claim 1, further comprising guide surfaces for guiding said rotor cover with respect to said opener roller housing.

7. The open-end spinning device as in claim 6, wherein said guide surfaces are formed integral with said stop.

8. The open-end spinning device as in claim 7, wherein said guide surfaces are formed on both sides of said stop, said stop and said guide surfaces forming a generally U-shaped member.

9. The open-end spinning device as in claim 6, wherein said guide surfaces comprise centering ramp sections for centering said rotor cover with respect to said opener roller housing and aligning said first and second fiber feeding channel sections in said operating position of said rotor cover.

10. The open-end spinning device as in claim 1, further comprising a gauge and wherein said stop is configured for interacting with said gauge for axially adjusting said rotor shaft support, or for interacting with said rotor cover.

11. The open-end spinning device as in claim 10, further comprising a connecting element disposed between said gauge and said stop, said connecting element comprising a profile matching said stop.

12. The open-end spinning device as in claim 11, wherein said stop is configured for interacting with said rotor cover for axially adjusting said rotor shaft support, said rotor cover being mateable with said stop and defining a surface against which a gauge is positioned during axial adjustment of said rotor shaft support.

13. The open-end spinning device as in claim 12, further comprising a connecting element disposed between said rotor cover and said stop, said connecting element comprising a profile matching said stop.

14. The open-end spinning device as in claim 13, wherein said stop comprises guiding surfaces for positioning said rotor cover relative said opener roller housing, said connecting element comprising a profile matching said guiding surfaces.

15. The open-end spinning device as in claim 1, wherein said rotor cover has a yarn draw-off nozzle which is exchangeable by a gauge supporting element, a shaft-like gauge being insertable between said gauge supporting element and said rotor shaft support for precisely adjusting said rotor shaft support.

* * * * *